US005224712A

United States Patent [19]

Laughlin et al.

[11] Patent Number: 5,224,712

[45] Date of Patent: * Jul. 6, 1993

[54] CARD MARK SENSOR AND METHODS FOR BLACKJACK

[75] Inventors: Donald J. Laughlin; Lawrence E. Wagoner, both of Laughlin, Nev.

[73] Assignee: No Peek 21, Laughlin, Nev.

[ * ] Notice: The portion of the term of this patent subsequent to May 5, 2009 has been disclaimed.

[21] Appl. No.: 866,582

[22] Filed: Apr. 10, 1992

Related U.S. Application Data

[63] Continuation of Ser. No. 662,690, Mar. 1, 1991, Pat. No. 5,110,134.

[51] Int. Cl.[5] ..... A63F 1/06

[52] U.S. Cl. ..... 273/304; 273/148 R; 273/309

[58] Field of Search ..... 273/304, 305, 309, 149 P, 273/148 R; 434/128, 129; D21/45, 42–44

[56] References Cited

U.S. PATENT DOCUMENTS

| | | | |
|---|---|---|---|
| 294,886 | 3/1884 | Lenril | 108/23 |
| 298,991 | 5/1884 | Levey | 273/305 |
| D. 317,951 | 7/1991 | Miller | D21/57 |
| 769,799 | 9/1904 | Hopkins | 272/8 M |
| 848,042 | 3/1907 | Musgrave | 273/309 |
| 1,568,206 | 1/1926 | Brandt | 273/296 |
| 1,590,463 | 6/1926 | Wood | 88/29 |
| 1,887,203 | 11/1932 | Hoke | 273/293 |
| 1,919.922 | 7/1933 | Baker, Jr. et al. | 353/34 |
| 1,986,362 | 1/1935 | Sachsenmaier et al. | 273/148 |
| 2,038,734 | 4/1936 | Hardy | 35/8 |
| 2,046,595 | 7/1936 | Yerkes | 273/136 |
| 2,051,615 | 8/1936 | Miles | 273/149 |
| 2,192,860 | 3/1940 | Bennett et al. | 40/2.2 |
| 2.224,646 | 12/1940 | Friedman et al. | 209/111 |
| 2,291,104 | 7/1942 | Radzyner | 35/22 |
| 2,325,490 | 7/1943 | Elftman | 88/74 |
| 2,344,197 | 4/1944 | Barnard | 20/0.5 |
| 2,607,595 | 8/1952 | Mathew | 273/152.42 |
| 2,683,604 | 7/1954 | Hassan | 273/152.1 |
| 2,760,779 | 8/1956 | Ogden et al. | 273/149 |
| 2,766,989 | 10/1956 | Silverston | 273/149 |
| 2,883,908 | 4/1959 | Copeland | 88/29 |
| 2,950,005 | 8/1960 | MacDonald | 209/74 |
| 3,034,512 | 5/1962 | Hunter | 129/16.1 |
| 3,147,978 | 9/1964 | Sjostrand | 273/149 |
| 3,152,256 | 10/1964 | Zuck et al. | 250/209 |
| 3,165,319 | 1/1965 | Benima | 273/149 |
| 3,169,186 | 2/1965 | Howard | 259/71 |
| 3,176,270 | 3/1965 | Reumerman et al. | 340/146.3 |
| 3,179,001 | 4/1965 | Silverman | 88/24 |
| 3,209,471 | 10/1965 | Brittan | 35/18 |
| 3,222.071 | 12/1965 | Lang | 273/149 |
| 3,254,201 | 5/1966 | Miller | 235/61.7 |
| 3,263,999 | 8/1966 | McCoy | 273/152.1 |
| 3,283,417 | 11/1966 | Lohmar | 35/9 |

(List continued on next page.)

FOREIGN PATENT DOCUMENTS

| | | | |
|---|---|---|---|
| 488797 | 12/1952 | Canada | 273/304 |

(List continued on next page.)

OTHER PUBLICATIONS

Scarne's Encyclopedia of Games by John Scarne, Harper & Row, Publishers, 1973, p. 1 and pp. 276–286.

*Primary Examiner*—Benjamin H. Layno
*Attorney, Agent, or Firm*—Lynn G. Foster

[57] ABSTRACT

A novel method and apparatus for determining whether or not a hole card is a member of a blackjack pair without direct observation of the hole card. The cards are separably marked in groups of aces and of face cards and tens. Each mark is detectable by a card mark sensor. The card mark sensor is used to differentially determine whether or not the hole card is a member of predetermined group when a card is placed face down therein. Thus, when the dealer receives a faceup member of a blackjack pair, the hole card is inserted into the sensor and determined to be or not to be the other member of the blackjack pair immediately and without observation of the face of the hole card. If the hole card is the other member of the blackjack pair play is stopped, and the next hand is thereby more quickly started. If the dealer does not have blackjack, play continues without knowledge by either player or dealer of the actual value of the hole card.

28 Claims, 4 Drawing Sheets

U.S. PATENT DOCUMENTS

| | | | |
|---|---|---|---|
| 3,312,473 | 4/1967 | Friedman et al. | 273/149 |
| 3,343,279 | 9/1967 | Elkins | 35/26 |
| 3,353,829 | 11/1967 | Board | 273/131 |
| 3,417,490 | 12/1968 | Chuy et al. | 35/9 |
| 3,426,179 | 2/1969 | Grimm et al. | 235/435 |
| 3,453,598 | 7/1969 | Schweizer | 340/149 |
| 3,456,117 | 7/1969 | Ritzert et al. | 250/219 |
| 3,466,775 | 9/1969 | Smith | 40/52 |
| 3,468,046 | 9/1969 | Makishima | 40/2.2 |
| 3,477,156 | 11/1969 | Naito | 40/2.2 |
| 3,489,907 | 1/1970 | Kenez | 250/219 |
| 3,500,047 | 3/1970 | Berry | 250/71 |
| 3,512,130 | 5/1970 | Hulett | 340/149 |
| 3,513,320 | 5/1970 | Weldon | 250/219 |
| 3,529,829 | 9/1970 | Siefert | 273/149 |
| 3,564,734 | 2/1971 | Abraham | 35/53 |
| 3,601,584 | 8/1971 | Kashio | 235/61.11 E |
| 3,604,899 | 9/1971 | Donohoe | 235/61.11 E |
| 3,624,360 | 11/1971 | Collier et al. | 23/61.11 R |
| 3,627,991 | 12/1971 | Beall et al. | 235/61.11 E |
| 3,647,275 | 3/1972 | Ward | 235/61.11 |
| 3,648,242 | 3/1972 | Grosbard | 340/149 |
| 3,658,342 | 4/1972 | Boren | 273/149 |
| 3,673,416 | 6/1972 | Berler | 250/219 |
| 3,676,644 | 7/1972 | Vaccaro et al. | 235/61.11 |
| 3,679,876 | 7/1972 | Faith et al. | 235/61.7 R |
| 3,690,670 | 9/1972 | Cassady et al. | 273/149 P |
| 3,714,396 | 1/1973 | Stambler | 325/61.11 C |
| 3,716,238 | 2/1973 | Porter | 273/149 P |
| 3,731,936 | 5/1973 | Copeland | 273/149 P |
| 3,742,616 | 7/1973 | Heller | 35/58 |
| 3,743,294 | 7/1973 | Forster | 273/149 |
| 3,751,041 | 8/1973 | Seifert | 273/149 P |
| 3,761,683 | 9/1973 | Rogers | 235/61.7 |
| 3,768,813 | 10/1973 | Reynolds | 273/151 |
| 3,779,554 | 12/1973 | Brix | 273/131 |
| 3,787,702 | 1/1974 | Hujer et al. | 250/561 |
| 3,791,516 | 2/1974 | Tramposch | 209/74 |
| 3,814,436 | 6/1974 | Boren | 273/149 P |
| 3,822,376 | 7/1974 | Kok et al. | 235/61.11 R |
| 3,858,797 | 1/1975 | Takeuchi | 235/61.11 R |
| 3,897,954 | 8/1975 | Erickson et al. | 273/149 R |
| 3,929,339 | 12/1975 | Mattioli | 273/148 A |
| 3,944,230 | 3/1976 | Fineman | 273/149 R |
| 3,947,666 | 3/1976 | Carlson | 235/61.11 E |
| 3,956,054 | 5/1976 | Griswold et al. | 156/379 |
| 4,014,549 | 3/1977 | Cywar | 273/152.41 |
| 4,088,265 | 5/1978 | Garcyznski | 235/454 |
| 4,109,143 | 8/1978 | Yamaguchi et al. | 235/462 |
| 4,126,373 | 11/1978 | Moraw | 350/3.61 |
| 4,146,229 | 3/1979 | Morse | 273/150 |
| 4,171,864 | 10/1979 | Jung et al. | 350/3.61 |
| 4,211,918 | 7/1980 | Nyfeler et al. | 235/454 |
| 4,237,375 | 12/1980 | Granholm | 235/487 |
| 4,277,844 | 7/1981 | Hancock et al. | 371/38 |
| 4,310,160 | 1/1982 | Willette et al. | 273/149 R |
| 4,314,700 | 2/1982 | Dylag | 273/148 R |
| 4,317,029 | 2/1982 | Warthan | 235/454 |
| 4,335,302 | 6/1982 | Robillard | 235/462 |
| 4,442,170 | 4/1984 | Kaule et al. | 428/333 |
| 4,445,028 | 4/1984 | Huber | 235/472 |
| 4,480,840 | 11/1984 | Chang | 273/292 |
| 4,534,365 | 8/1985 | Bonetta et al. | 128/779 |
| 4,534,562 | 8/1985 | Cuff et al. | 273/149 R |
| 4,544,835 | 10/1085 | Drexler | 235/487 |
| 4,544,836 | 10/1985 | Galvin et al. | 235/487 |
| 4,575,623 | 3/1986 | Cononi et al. | 235/383 |
| 4,586,711 | 5/1986 | Winters et al. | 273/138 R |
| 4,599,511 | 7/1986 | Stiller | 235/459 |
| 4,656,344 | 4/1987 | Mergenthaler et al. | 235/462 |
| 4,675,516 | 6/1987 | Guion | 235/441 |
| 4,743,746 | 5/1988 | Murschall et al. | 235/486 |
| 4,807,883 | 2/1989 | Silverman | 273/145 |
| 4,822,050 | 4/1989 | Normand et al. | 237/149 P |
| 4,994,658 | 2/1991 | Takahashi et al. | 235/473 |
| 4,998,737 | 3/1991 | Lamle | 273/296 |
| 5,004,898 | 4/1991 | Ihsikawa et al. | 235/475 |
| 5,039,102 | 8/1991 | Miller | 273/304 |
| 5,067,713 | 11/1991 | Soules et al. | 273/149 |

FOREIGN PATENT DOCUMENTS

| | | | |
|---|---|---|---|
| 310516 | 8/1989 | European Pat. Off. . | |
| 1039429 | 9/1958 | Fed. Rep. of Germany . | |
| 7911589 | 12/1979 | Fed. Rep. of Germany . | |
| 3807127 | 3/1988 | Fed. Rep. of Germany | 273/292 |
| 907332 | 3/1946 | France . | |
| 1356398 | 2/1964 | France . | |
| 1429348 | 5/1966 | France . | |
| 2109213 | 6/1972 | France . | |
| 2186839 | 11/1974 | France . | |
| 2497677 | 1/1981 | France | 273/292 |
| 2540737 | 8/1984 | France . | |
| 2602151 | 7/1986 | France | 273/292 |
| 2576518 | 8/1986 | France . | |
| 1436381 | 5/1976 | United Kingdom | 273/292 |

FIG. 7
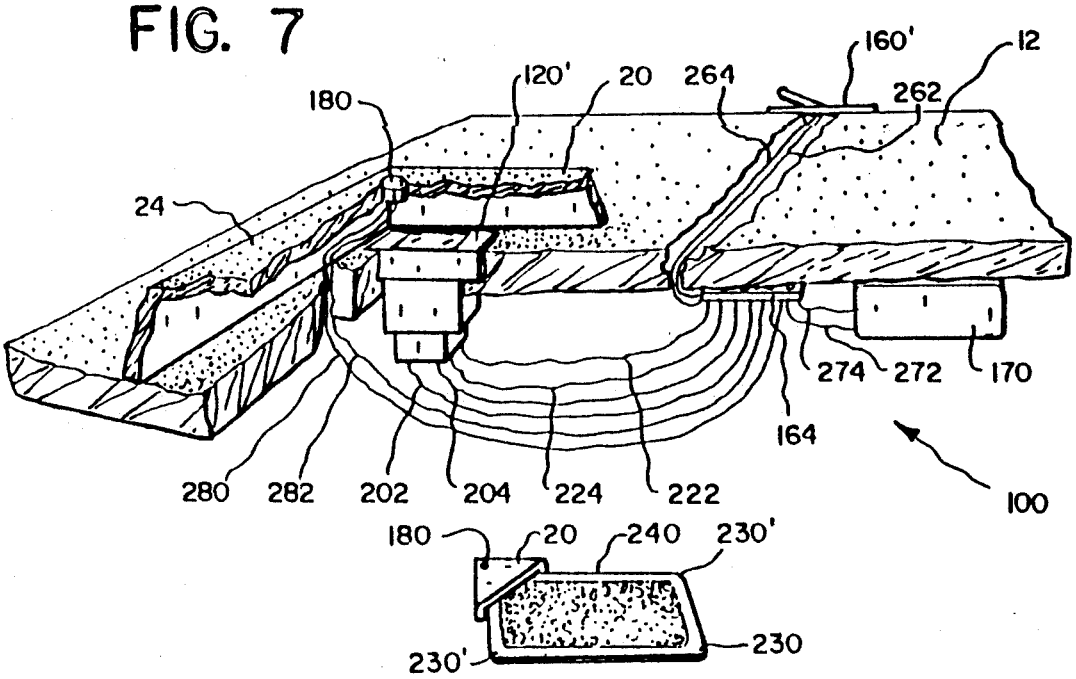
FIG. 8
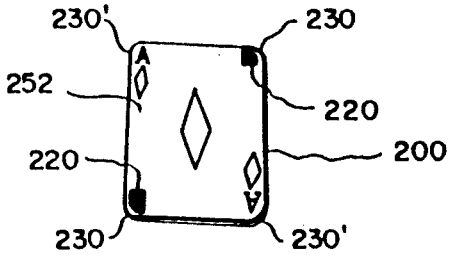
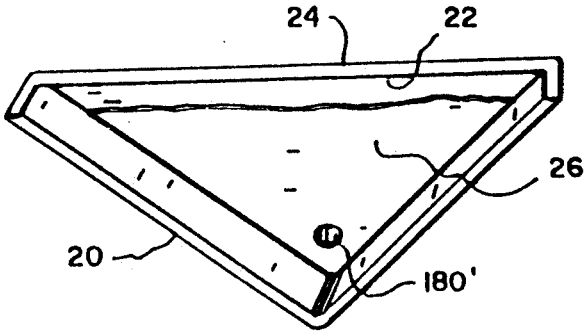
FIG. 9

CARD MARK SENSOR AND METHODS FOR BLACKJACK

CONTINUITY

This application is a continuation of our co-pending U.S. patent application Ser. No. 662,690, filed Mar. 1, 1991, now U.S. Pat. No. 5,110,134.

FIELD OF THE INVENTION

This invention relates to tools and apparatus for professional gaming and is particularly related to card mark sensing for the game of Blackjack

BACKGROUND

The game of Blackjack is commonly played in casinos worldwide. In a casino, the game of Blackjack involves a dealer and one or more players who play against cards dealt the dealer.

Another rule, basic to the game, is that each player attempts to draw cards until the sum of the cards are as close to twenty-one as possible, without exceeding twenty-one. Whenever the sum of the cards in a single hand exceeds twenty-one, the player or dealer, holding the cards loses.

Cards are dealt to each player, including the dealer, with at least one card (the "hole" card) down. To speed play, when cards, the hole card is commonly privately perused by the dealer to see if the hole card is the other member of the blackjack pair. If the hole card is the other member of the blackjack pair, play stops and the dealer wins.

Those skilled in the art of Blackjack understand that statistics play a very important part in winning or losing. Numbers of methods have been conceived through the years for integrating knowledge of cards played into a scheme which determines the magnitude of a bet, or whether another card should be taken. Equally as important, when a player is making a decision about whether or not to ask for another card, is a knowledge of the value of the dealers hole card, especially when the showing card is a face card.

For an unscrupulous dealer, who has a player as an accomplice, a look at the hole card, to determine whether or not the dealer's cards comprise a blackjack, provides an opportunity to determine the value of the hole card. With a knowledge of the value of the hole card, the unethical dealer is able to signal the player accomplice the relative value of the card in a manner which is subtle and generally undetectable by casino management. With that knowledge, the accomplice makes a more knowledgeable decision concerning requesting or declining being hit with another card and thereby significantly tilts the odds of winning away from the casino.

BRIEF SUMMARY AND OBJECTS OF THE INVENTION

In brief summary, this novel invention alleviates all of the known problems comprising practices related to unethical communications between a dealer and accomplices regarding information derived by dealer from looking at a hole card before all of the players have completed their draw in each hand.

The invention comprises apparatus and methods which provide a knowledge of whether or not a card is one of a group of values or of a predetermined value while the card remains face down and in play in a game of Blackjack. Each card of the group of values or of the predetermined value comprises a detectable mark on the face thereof. A sensor apparatus is accessibly placed wherein at least a portion of the card comprising the location of the detectable mark is insertably placed. The sensor apparatus senses the detectable mark when the card comprises the mark and energizes a visible or audible signal, otherwise no such signal is provided.

Accordingly, it is a primary object to provide a sensor for detecting a card mark during a game of Blackjack while the card remains face down on a playing surface.

It is a key object to provide at least one card which comprises a mark on the face thereof which is detectable by the sensor when the at least one card is disposed face down on the playing surface during the play of the game of Blackjack.

It is another object to provide a self-contained sensor of the at least one mark on the at least one card used in the game of Blackjack which is part of a portable gaming table and does not require connection to an external power source.

It is an object to provide a sensor of a mark on a card used in the game of Blackjack which is battery driven.

It is an object to provide a sensor of a mark on a card used in the game of Blackjack which only draws power from a power source while the presence of a mark is being sought.

It is another object to provide a sensor which differentially senses at least two different marks on at least two different cards whereby a determination is made of the presence or absence of each of marks on each of the cards and a detected differentiation is made between the at least two cards and also between other cards not so marked.

These and other objects and features of the present invention will be apparent from the detailed description taken with reference to accompanying drawings.

BRIEF DESCRIPTION OF THE DRAWINGS

FIG. 7 is a magnified perspective of a section similar to the one in FIG. 5, but with different placement and use of a switch and a different light emitting diode and light sensing diode component pair.

FIG. 8 is a magnified view of a portion of the playing surface of the Blackjack gaming table seen in FIGS. 1 and 2 with a sensible portion of the hole card rotated and oriented differently than seen in FIG. 3 and, thereby, disposed within the stop.

FIG. 9 is an inverted perspective of the stop seen in part in FIG. 7.

DETAILED DESCRIPTION OF THE ILLUSTRATED EMBODIMENTS

Figure 1:
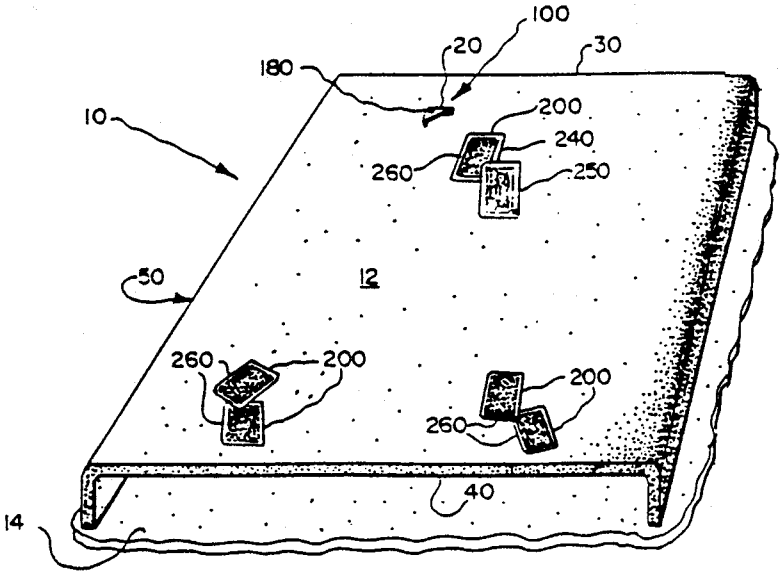
FIG. 1 is a perspective of a Blackjack gaming table comprising a playing surface and a stop covering a card mark detector.

In this description, the term proximal is used to indicate the segment of the device normally closest to a dealer when it is being used. The term distal refers to the other end of the device. Reference is now made to the embodiments illustrated in FIGS. 1-9 wherein like numerals are used to designate like parts throughout. As seen in FIG. 1, a Blackjack gaming table 10 comprises a portion 50 which raises a playing surface 12 above a support surface 14 to a height comfortable for play. The playing surface 12 is formed of a felt or other material well known and commonly used in the game of Blackjack and whereupon cards 200 are dealt to a dealer and players (not shown).

Figure 3:
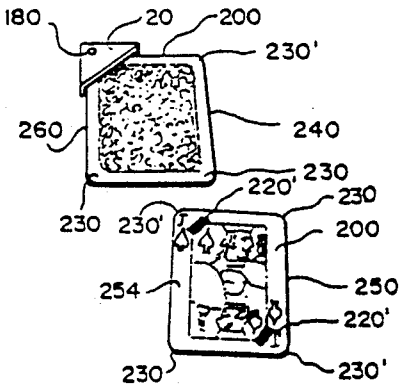
FIG. 3 is a magnified view of a portion of the playing surface of the Blackjack gaming table seen in FIGS. 1 and 2 with a detectable portion of the hole card disposed within the stop.
Figure 6:
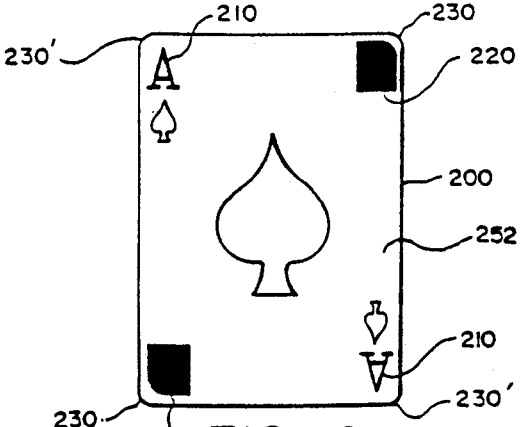
FIG. 6 is a card comprising a detectable mark in two preselected corners.

As seen in FIG. 3 and 6, each card 200 to be positively identified as a member of a blackjack pair of cards bears at least one detectable mark 220' or 220, respectively. Each such mark comprises a dark surface or spot which is sensible photoelectrically. However, other marks may be used within the scope of the invention. Such marks may comprise magnetic ink or magnetized matter, reactive inks, such as fluorescent dyes, safe levels of self radiating inks, or light polarizing surfaces.

Each card 200 comprises a set of opposing corners 230' or 230. A sensible or detectable mark 220 is placed in each corner 230 not containing identifying indicia 210 for a group of cards 200 comprising each ace 252. For another group of cards 200 comprising each face card or ten 254 a sensible mark 220' is placed in each corner 230' disposed such that identifying indicia remain readable. Even so, placement of detectable marks may be disposed at other places than as seen at corners 230 and 230' within the scope of the invention. It is expected that dealers and players alike would be aware of such card marks and that each card mark 220 and 220' is undetectable by players and dealers while the card 200 is disposed in face down position 260 during play, unless the card is in the process of being sensed at a sensor 100, to be described in detail hereafter.

A blackjack comprises one card 200 of each of two groups of cards 200, the first group comprising each ace 252 and the second group comprising each face card and ten 254. As stated earlier, each ace 252 comprises mark 220 in each corner 230 as seen in FIG. 6. Each face card and ten 254 of the second group comprises mark 220' either separately distinguishable from mark 220 by sensor 100 or disposed for sensing at a different location by sensor 100, thereby allowing a differentiation between the two groups to be made. Each mark 220' is disposed in corner 230' on each face card or ten 254 while each mark 220 is disposed in corner 230 on each ace 252 permitting differentiation by which corner is inserted into sensor 100.

As seen in FIG. 1, the dealer, disposed near edge 30 along surface 12 is dealt one card 200 disposed in face up position 250 and one card in face down position 260. Each player is normally disposed near edge 40 of surface 12. The face down card proximal to the position of the dealer is known as a hole card and generally referred to as hole card 240. Sensor 100 is disposed on surface 12 proximal to the dealer to facilely receive an inserted corner of card 200. If the card disposed in face up position 250 is a face card or a ten 254, play is legitimately speeded by a test to see if hole card 240 is an ace 252 and dealer therefore has a blackjack. Similarly, if the card disposed in face-up position 250 is an ace 252, play is speeded by a test to see if hole card 240 is a face card or ten 254.

Figure 2:
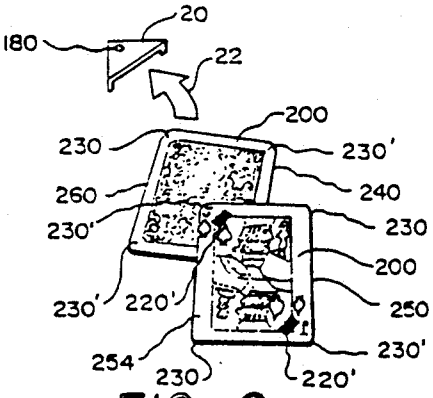
FIG. 2 is a magnified view of a portion of the playing surface of the Blackjack gaming table seen in FIG. 1 showing relative position of dealer cards and direction of motion of a hole card when moved toward the stop.

As seen in FIG. 2, hole card 240 is maintained in face down position 260 and sensible corner 230 is moved proximally to stop 20 as indicated by arrow 22 when the card 200 in face-up position 250 is a face card or ten 254. Once hole card 240 is disposed at stop 20, as seen in FIG. 3, an indicator provides a detectable signal that separates a card 200 bearing a mark 220 from one which does not bear such a mark. The indicator is a visually discernable light emitting diode 180 which illuminates when the hole card is an ace 252.

If the card 200 in face-up position 250 is ace 252, hole card 240 is maintained in face down position 260, but rotated 90° to be disposed at stop 20 as seen in FIG. 8. Thus oriented, hole card 240 is sensed by sensor 100 and light emitting diode 180 is illuminated upon detection of a mark 220' at corner 230' of face card or ten 254. Thereby, one group of cards 200 each comprising an ace 252 is detected independently from the other group detected by sensor 100 comprising a face card or ten 254. Importantly, the dealer knows proper orientation of the card 200 to be read by the value of the card 200 in face-up position 250. If the card 200 in face-up position 250 is an ace 252, the dealer inserts a corner 230 into sensor 100, whereupon illumination of light emitting diode 180 indicates a blackjack. Restated, if the card 200 in face-up position 250 is a face card or ten 254, the dealer inserts a corner 230' into sensor 100, whereupon illumination of light also indicates a blackjack.

Figure 4:
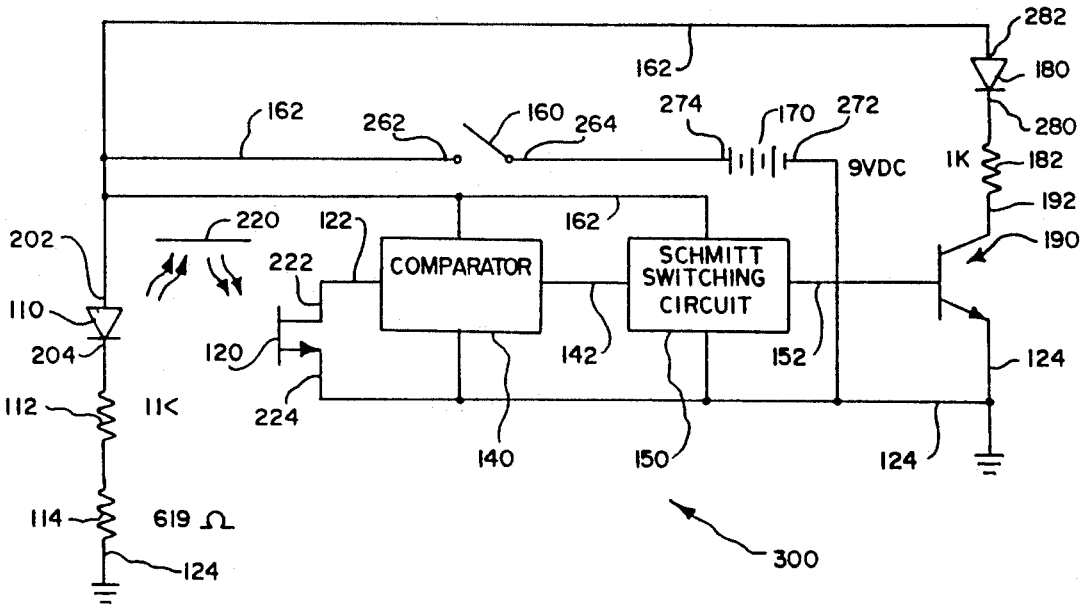
FIG. 4 is a block diagram of a card mark sensing circuit.
Figure 5:
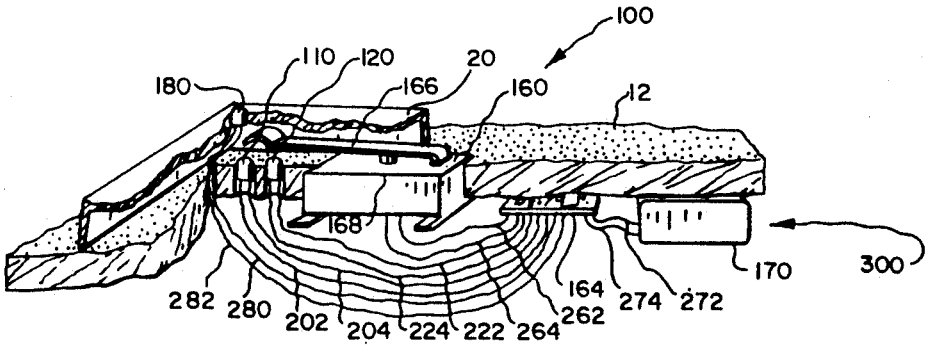
FIG. 5 is a magnified view of the stop and a portion of the Blackjack gaming table with portions cut away for clarity of presentation.

A sensing circuit 300, disposed in close relation to stop 20, is seen in FIGS. 4 and 5. As best seen in FIG. 4, the sensing circuit 300 of a currently preferred embodiment comprises a battery 170 which provides power to the rest of the circuit only when normally open switch 160 is closed, one lead 174 of battery 170 being connected to lead 264 of switch 160. Switch 160 comprises a card 200 presence sensor. That is, a card 200 disposed at stop 20 operates to physically close switch 160 thereby activating sensing circuit 300 as is described in more detail hereafter.

A lead 262 from the normally open side of switch 160 provides power to line 162 which provides high voltage power distribution for sensing circuit 300. Power through line 162 is provided to a light emitting diode 110 through connecting lead 202. Another connecting lead 204 connects the other side of light emitting diode 110 to a 1 Kohm resistor 112 serially connected to a 619 ohm resistor, the other end of which is grounded.

When powered by a closure of switch 160, light emitted from light emitting diode 110 reflects off card 200 surface in the vicinity of stop 20, the intensity and character of the reflected light being a function of whether o not a mark such as mark 220, seen in FIG. 4, is on the card 200 disposed at stop 20. A light sensitive diode 120 is disposed in known manner to detect the intensity of light reflected from an area where a mark 220 may be disposed on the card 200 disposed at stop 20. One lead of light sensitive diode 120 is connected through line 224 to a common ground 124 which connects to battery 170 through a lead 272. The other lead 222 of light sensitive diode 120 connects through a lead 122 to a comparator 140. Comparator 140 comprises connections to battery power through lead 162, to ground through lead 124, and to light sensitive diode 120 through 122. Further comparator 140 comprises a connection to a Schmitt switching circuit 150 through line 142. Schmitt switching circuit 150 also comprises like connections to power through lead 162 and to ground through lead 124. Comparator 140 and Schmitt switching circuit 150 comprise circuits which are well known in the art and are, therefore, not treated further herein.

The output of Schmitt switching circuit connects to an NPN transistor 190 through lead 152. NPN transistor 190 comprises a grounded emitter and a collector serially connected through lead 192 to a 1 Kohm resistor 182 to lead 280 and therefrom to light emitting diode 180. Lead 280 connects light emitting diode 180 to power supplying lead 162. Light sensitive diode 120, comparator 140, and Schmitt switching circuit 150 act in combination to filter a signal derived from the area of a mark 220 to hold transistor 190 from conducting when a mark 220 is not sensed on tested card 200. Conversely, transistor 190 is caused to conduct by action of the combination when a mark 220 is sensed. When transistor 190 conducts, light emitting diode 180 is illuminated indicating a sensed mark 220 or 220' on a stop 20 inserted card 200.

Thus, when a card 200 is disposed face down at stop 20 as seen in FIG. 3, switch 160 is closed and as a consequence of a sensed mark 220, light emitting diode illuminates to signal detection of ace 252. Similarly, when card 200 is disposed face-down at stop 20 as seen in FIG. 8, switch 160 is also closed and as a consequence of a sensed mark 220' light emitting diode illuminates to differentially detect a face card or ten 254. No illumination of light emitting diode 180 indicates no detected mark.

Components are preferably disposed near stop 20 as best seen in FIG. 5. Unless otherwise specified, all of mark sensing circuit 300 components are disposed on printed circuit card 164, preferably affixed underneath raised portion 50, as seen in FIG. 5. Battery 170 is also disposed below raised portion 50 and is interconnected to printed circuit card 164 via connecting lines 272 and 274. Stop 20 comprises a triangular member which provides a light shield for light sensing circuit 300 and a physical barrier whereby a card slid into stop 20 and above switch 160 displaces a switch lever 166 thereby depressing switch activator 168 and closing switch 160 Light emitting diode 110 is disposed deeply within the shielding surface of stop 20 and lights when the presence of card 200 is sensed and when power is provide by closure of normally open switch 160

Light emitting diode 110 is connected to printed circuit card 164 through leads 202 and 204. As seen in FIG. 5, light sensitive diode 120 is disposed to receive a signal from light emitting diode 110 as it reflects from the area of mark 220 or 220' on a card 200. Leads 222 and 224 connect light sensitive diode 120 to printed circuit card 164. In similar manner, leads 262 and 264 from normally open switch 160 connect to printed circuit 164.

Light emitting diode 180 indicator is disposed in the top of stop 20 where it is visible to both dealer and player. As seen in FIGS. 1–3 and 5, light emitting diode 180 is disposed in the corner of stop 20, although any conveniently seen position may be used.

In Blackjack play, each time a face card or ten 254 appears as dealers card in face-up position 250, hole card 240 is inserted into stop 20 in the orientation seen in FIG. 3. When light emitting diode 180 illuminates, an ace is detected and play stops with dealer winning except as to a player who has a push. If light emitting diode 180 does not illuminate when card 200 is disposed at stop 20, play continues. Similarly, each time an ace 252 is dealt as the card in face-up position 250, hole card 240 is inserted into stop 20 in the orientation seen in FIG. 8. As above, when light emitting diode 180 illuminates, card 254 is detected and play stops with dealer winning except as to a player who has a push. As before, when light emitting diode 180 does not illuminate, play continues.

Figure 11:
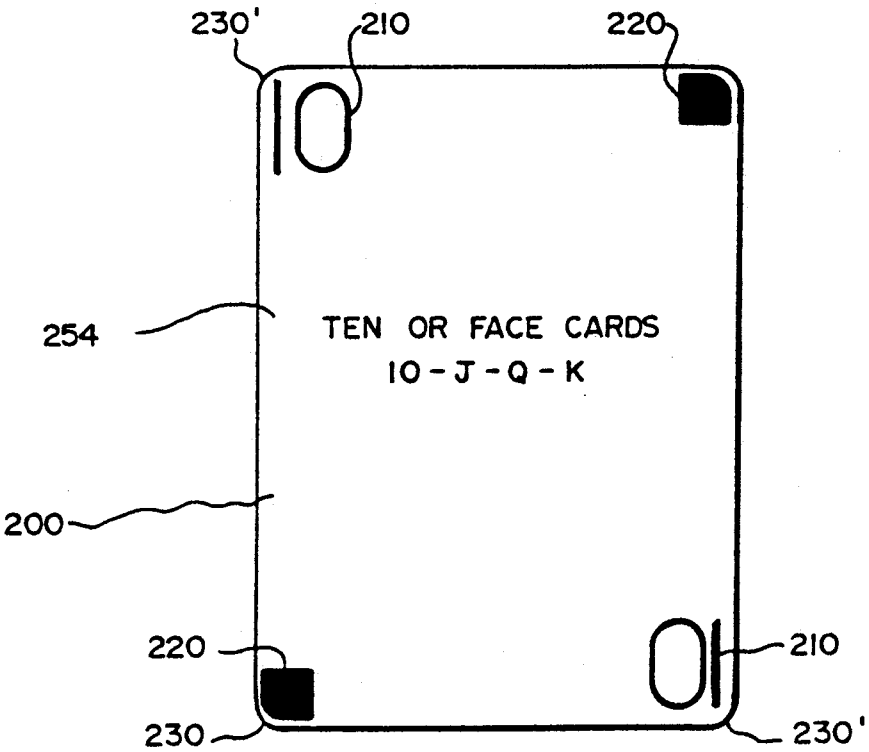
FIG. 11 is a card which is a member of a blackjack pair comprising the cards of FIGS. 10 and 11 and whereon the detectable mark is disposed in corners opposite the card in FIG. 10.
Figure 10:
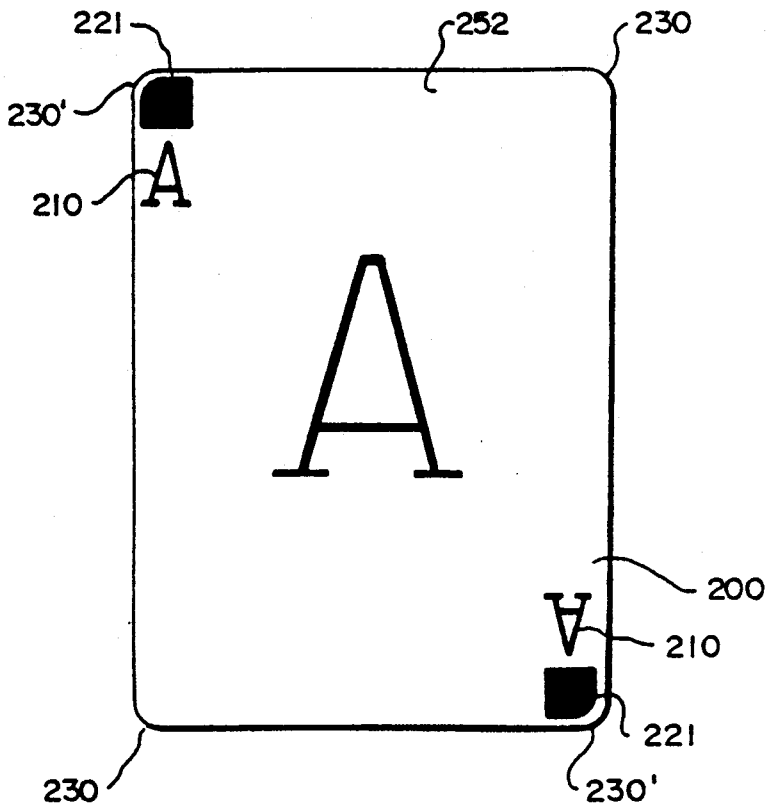
FIG. 10 is a card similar in value in the game of Blackjack to the card seen in FIG. 6 and whereon detectable marks are disposed in corners opposite the card in FIG. 6.

Another embodiment of card markings is seen in combination in FIGS. 10 and 11. As seen in FIG. 10, ace 252 comprises indicia 210 removed a short distance from each corner 230' to provide space for a sensor 100 detectable mark 221. When a face card or ten 254 is face up, hole card 240 is oriented and disposed at stop 20 as seen in FIG. 8 for purposes of detecting mark 221, since in this embodiment the mark on each ace 252 is on corner 230' rather than on corner 230 as seen in the embodiment of FIG. 6. Similarly, as seen in FIG. 11, face card or ten 254 comprises sensor 100 detectable mark 220 in each corner 230. Detection of mark 220 is accomplished by disposing hole card 240 in stop 20 in the orientation seen in FIG. 3. By this, it is seen that orientation of cards at stop 20 is based upon the relative location of marks to be detected on the deck of cards being used at the time of play.

Another embodiment is seen in FIG. 8. The circuit for this embodiment is that same as seen in FIG. 4. However, a photosensor 120' which comprises both a light emitting diode and light sensitive diode and performs functions of light emitting diode 110 and light sensitive diode 120 in the light sensing circuit 300. Photosensor 120' may be an EE-SB5VC photosensor available from Omron. Further, card sensing switch 160 is replaced by a single pole single throw switch 160' whereby power is turned on at the beginning of play and turned off at the end of play rather than being turned on each time a card is inserted into stop 20.

In this embodiment, switch 160' is turned on before play begins to provide constant power to sensing circuit 300. As seen in FIG. 9, wherein stop 20 is inverted placing the top 24 of stop 20 distal to the viewer and the underside 22 proximal to the viewer, a reflective surface 26 is seen adhesively or otherwise bonded to underside 22. Stop 20 is seen to comprise a hole 180' for later insertion of light emitting diode 180. Reflective surface 26 continuously reflects light emitted from photosensor 120' thereby holding light emitting diode 180 "off". Thus, light emitting diode 180 lights only when a card comprising a mark 220 or 220' is interposed between reflective surface 26 and light producing photosensor 120'. When a card comprising a mark 220 or 220' is so interposed, light emitting diode is set into a conducting state each time a mark 220 or 220' is sensed.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A plurality of blackjack playing cards comprising a group of sixteen, each card of the group having a blackjack value of ten and each card of the group comprising additional face indicia at at least one specific otherwise unoccupied site on the face of each card representative of only the blackjack numerical value of ten, without regard to its suit accommodating face down inspection of the face site using components of an inspection device during a game of blackjack.

2. In combination:

a device mounted to a blackjack table comprising a plurality of components by which indicia selectively disposed at a specific otherwise unoccupied site on the face of a blackjack card is ascertained while face down and while aligned with at least one component of the device;

a deck of blackjack playing cards, the deck comprising a group of sixteen of said blackjack playing cards, each card of the group having a blackjack value of ten and each card of the group comprising said face indicia at an otherwise unoccupied specific site representative of only the blackjack value of ten.

3. The combination of claim 2 wherein the deck of blackjack playing cards further comprises a second group of four blackjack cards, each card of the second group comprising an ace and having said face indicia at a different otherwise unoccupied specific site representative of only the blackjack value of an ace.

4. A method of playing a game of blackjack, comprising the steps of:

providing a deck of blackjack playing cards comprising a group of sixteen cards each of the sixteen blackjack cards having a blackjack value of ten and each comprising face indicia at an otherwise unoccupied specific site representative of only the blackjack value of ten;

inserting, during a game of blackjack, a down card of the deck face down into a device mounted to a blackjack table and comprising interior components;

inspecting, during a game of blackjack, using the interior components of the device, the specific site of the inserted down card to ascertain when said face indicia is present.

5. A method of playing a game of blackjack, comprising the steps of:

providing a deck of blackjack playing cards comprising a first group of sixteen cards each having a blackjack value of ten and comprising face indicia at first otherwise unoccupied specific site representative of only the blackjack value of ten, the deck further comprising a second group of four cards each having a blackjack value of eleven and having face indicia at a second otherwise unoccupied, specific site representative of the blackjack value of eleven;

inserting, during a game of blackjack, a down card of the deck face down into a device mounted to a blackjack table and comprising interior components;

inspecting, during a game of blackjack, using the interior components of the device, the inserted down cards to ascertain from either site when the first or second indicia is present.

6. A deck of blackjack playing cards which are selectively marked with special face indicia comprising:

a first group of blackjack playing cards comprising sixteen cards each having a blackjack value of ten and each comprising unique face indicia representative of only the blackjack numerical value of ten;

a second group of blackjack playing cards comprising all cards having blackjack values within the range of two through nine, each card of the second group comprising a normal face without unique face indicia;

a third group of blackjack playing cards comprising four cards each having a blackjack value of eleven and each comprising unique face indicia representative, in a location different from the location of the face indicia on each of the cards of the first group, of only the blackjack numerical value of eleven.

7. A method of playing a game of twenty-one comprising the steps of:

during a game of blackjack, inserting the dealer's down card while face down into a device mounted to a blackjack table and comprising interior components;

ascertaining via the interior components of the device when the down card has a value of ten;

when it is so ascertained that the value of the dealer's down card is ten, declaring immediately the game to be ended if the dealer's up card is a card having a blackjack value of eleven.

8. A method of playing a game of twenty-one comprising the steps of:

during a game of blackjack, inserting the dealer's down card while face down into a device carried by a blackjack table and comprising interior components;

ascertaining via the interior components of the device when the down card has a value of ten;

when it is so ascertained that the value of the dealer's down card is ten, declaring immediately the game to be ended if the dealer's up card is an ace;

during a game of blackjack, inserting the dealer's down card while face down into the device;

ascertaining via the interior components of the device when the down card is a card having a blackjack value of eleven;

when it is so ascertained that the dealer's down card is a card having a blackjack value of eleven, declaring immediately the game to be ended if the dealer's up card has a value of ten.

9. A method of accelerating play of a game of blackjack comprising the steps of:

dealing an up card and a down card to each player and to the dealer;

ascertaining the blackjack value of the up card of the dealer;

if the dealer's up card has a blackjack value of eleven, inserting at least the face down card of the dealer into a device comprising interior components in a first orientation;

ascertaining via the interior components of the device if the inserted down card has a blackjack value of ten; and ending the game, without additional dealing steps, when the inserted card is a ten.

10. The method according to claim 9, comprising in a later game of blackjack the following steps:

inserting a face down card of the dealer into the device in a second orientation when the dealer's up card has a ten value;

ascertaining via the interior components of the device if the inserted down card has a blackjack value of eleven; and ending the game, without additional dealing steps when the inserted card has a value of eleven.

11. A method of conserving cards dealt from a deck of cards and, thereby, time taken to play a game of blackjack comprising the steps of:

dealing two down cards to each player other than the dealer and an up card and a down card to the dealer;

ascertaining the blackjack value of the up card of the dealer;

when the dealer's up card has a blackjack value of eleven, inserting at least the face down card of the dealer into a device comprising interior components in a first orientation;

ascertaining via the interior components of the device if the inserted down card has a blackjack value of ten; and ending the game, without additional dealing steps, when the inserted card has a ten value, thereby preserving cards yet undealt in the deck for use in an ensuing hand.

12. The method according to claim 11 comprising in a later game of blackjack the following steps:

inserting a face down card of the dealer into the device in a second orientation when the dealer's up card has a ten value;

ascertaining via the interior components of the device if the inserted down card has a blackjack value of eleven; and ending the game, without additional dealing steps when the inserted card has a value of eleven, thereby preserving cards yet undealt in the deck for use in an ensuing hand.

13. A plurality of blackjack playing cards each having a blackjack value of ten or eleven, all ten value cards of the plurality each comprising at least one mark in at least one first predetermined viewable face location representative of the blackjack numerical value of ten without regard to suit and all eleven value cards of the plurality each comprising at least one mark in at least one second predetermined viewable face location representative of the blackjack numerical value of eleven without regard to suit, the mark at the at least one first predetermined viewable face location being viewable face down by use of at least one component of a multi-component blackjack reader in a first playing card orientation in the reader and the mark at the at least one second predetermined viewable face location being viewable face down by use of at least the one component of the multi-component blackjack reader in a second playing orientation in the reader.

14. A plurality of blackjack playing cards each having a blackjack value of ten or eleven, each ten value card of the plurality comprising at least one mark in at least one first predetermined face location representative in intelligible form of the blackjack numerical value of ten independent of suit and each eleven value card of the plurality comprising at least one mark in at least one second predetermined face location representative in intelligible form of the blackjack numerical value of eleven independent of suit.

15. A plurality of blackjack playing cards according to claim 14 wherein each mark is disposed on the face near a corner of the card.

16. A plurality of blackjack playing cards according to claim 14 wherein each mark representative of a ten value is located in at least one specific corner face location of each ten value card and each mark representative of an eleven value is located in at least one other specific corner face location of each eleven value card.

17. A plurality of blackjack playing cards according to claim 14 wherein the at least one mark of each of the plurality of cards comprise an opaque face mark.

18. A deck of blackjack playing cards which are selectively value-detectable comprising:

a first plurality of twenty blackjack playing cards each card having a blackjack value of ten or eleven, each of the sixteen ten value cards of the first plurality comprising at least one additional face indicia in a first face location representative of only the blackjack numerical value of ten independent of suit and each of the four eleven value cards of the first plurality comprising at least one additional face indicia in a second face location representative of only the blackjack value of eleven independent of suit;

a second plurality of blackjack playing cards comprising the remainder of the deck, excluding the first plurality, comprising normal playing cards.

19. A blackjack detection system by which the game of blackjack is accelerated comprising:

a head adapted for use at a blackjack table comprising means for manually receiving a dealer's down card in a face down position in either of two orientations;

card numerical value ascertaining means disposed below the head comprising means (a) by which a card value of eleven is ascertained, when the down card has said value and is in one of said orientations within the head, from special indicia carried at a specific location on the face of each ace card and (b) by which a card value often is ascertained, when the down card has said value and is in the other of said orientations within the head, from special indicia carried at a second specific location on the face of each ten value card and (c) by which an absence of specific indicia on the face of all cards having a numerical value less than ten is ascertained;

notification means by which the ascertained card values (a), (b) and (c).

20. A system according to claim 19 wherein the card numerical value ascertaining means comprise illumination means.

21. A system according to claim 20 comprising switch means for enabling and disabling the illumination means.

22. A system according to claim 19 wherein the head is to the left of the dealer above a blackjack table and the means for accepting are adapted to receive the dealer's down card in either a direction away from the dealer or right-to-left as viewed by the dealer.

23. A full deck of blackjack playing cards, a portion of said blackjack playing cards in the blackjack deck comprising exactly twenty cards, each card having a blackjack value within the range of ten to eleven, four cards of the twenty cards comprising both normal ace indicia conventionally disposed on the face of each and additional face indicia in a first predetermined location representative in readable form of the blackjack numerical value of eleven only, sixteen of the twenty cards comprising both normal ten value indicia conventionally disposed on the face of each and additional face indicia in a second predetermined location representative in readable form of the blackjack numerical value of ten only.

24. A full deck of blackjack playing cards according to claim 23 wherein the additional face indicia of each of the twenty cards comprises a mark disposed in a corner area of each of the twenty cards.

25. A full deck of blackjack playing cards, a portion of said blackjack playing cards in the blackjack deck comprising exactly twenty cards, each card having a blackjack value within the range of ten and eleven, sixteen cards of the twenty cards comprising additional face indicia disposed in at least one specific corner location of each card having a blackjack value of ten and four cards of the twenty cards comprising addition of each indicia disposed in at least one other different specific corner location of each card having a blackjack value of eleven.

26. A full deck of blackjack playing cards according to claim 25 wherein the additional face indicia of each of the twenty cards comprise at least one opaque mark.

27. A method of playing a game of twenty-one at a more rapid pace comprising the steps of:

during the game, visually ascertaining when a dealer's up card is an ace;

thereafter inserting the dealer's down card while face down into a reading device;

ascertaining via the reading device if the dealer's down card has a value of ten;

when it is so ascertained that the value of the dealer's down card is ten, declaring immediately the game to be over.

28. A method of playing a game of twenty-one at a more rapid pace comprising the steps of:

during the game, visually ascertaining when a dealer's up card is an ace;

thereafter, inserting the dealer's down card while face down into a reading device;

ascertaining via the reading device if the dealer's down card has a value of ten;

when it is so ascertained that the value of the dealer's down card is ten, declaring immediately the game to be over;

during a game of twenty-one, ascertaining when the dealer's up card has a value of ten;

thereafter, inserting the dealer's down card while face down into the reading device;

ascertaining via the reading device if the dealer's down card is an ace;

when it is so ascertained that the dealer's down card is an ace, declaring immediately the game to be over.

* * * * *